United States Patent [19]

Bowlds et al.

[11] Patent Number: 4,477,198

[45] Date of Patent: Oct. 16, 1984

[54] MODIFIED RESISTIVE LAYER IN THERMAL TRANSFER MEDIUM HAVING LUBRICATING CONTACT GRAPHITE COATING

[75] Inventors: Patsy A. Bowlds, Lexington; David P. Dunn, Danville; Rex D. Fathergill, Frankfort; Hugh T. Findlay; Stafford, Donald W., both of Lexington, all of Ky.

[73] Assignee: International Business Machines Corporation, Armonk, N.Y.

[21] Appl. No.: 388,554

[22] Filed: Jun. 15, 1982

[51] Int. Cl.[3] ..... B41J 31/12

[52] U.S. Cl. ..... 400/120; 400/241.1; 400/247; 400/198; 428/913; 428/914

[58] Field of Search ..... 400/120, 247, 241.1; 252/8.6, 9, 11, 22, 29; 423/448; 427/180; 428/244, 352, 408, 412, 423.1, 424.7, 424.8, 900, 914, 913

[56] References Cited

U.S. PATENT DOCUMENTS

| | | | |
|---|---|---|---|
| 3,002,850 | 10/1961 | Fischer | 428/244 |
| 3,097,561 | 7/1963 | Stein | 427/180 X |
| 3,276,946 | 10/1966 | Cole et al. | 428/900 X |
| 3,359,128 | 12/1967 | Humphrey et al. | 427/180 X |
| 4,103,066 | 7/1978 | Brooks et al. | 400/241.1 X |
| 4,117,190 | 9/1978 | Akashi et al. | 428/900 |
| 4,188,434 | 2/1980 | Loran | 428/900 X |
| 4,213,870 | 7/1980 | Loran | 252/11 X |
| 4,253,775 | 3/1981 | Crooks et al. | 400/241.1 X |
| 4,269,892 | 5/1981 | Shattuck et al. | 400/241.1 X |
| 4,277,540 | 7/1981 | Aine | 428/900 X |
| 4,310,258 | 1/1982 | Scott | 400/241.1 |
| 4,320,170 | 3/1982 | Findlay | 400/241.1 X |
| 4,384,797 | 5/1983 | Anderson et al. | 400/241.1 X |

FOREIGN PATENT DOCUMENTS 16320 10/1980 European Pat. Off. .

OTHER PUBLICATIONS

IBM Technical Disclosure Bulletin, "Ribbon Support Film Coating", Findlay et al., vol. 15, No. 2, Jul. 1972, p. 368.

IBM Technical Disclosure Bulletin, "Embedded Graphite Lamination on Thermal Ribbon", Findlay et al., vol. 25, No. 7A, Dec. 1982, p. 3193.

IBM Technical Disclosure Bulletin, "Graphite-Resin Lamination on Thermal Ribbon", Findlay et al., vol. 25, No. 7A, Dec. 1982, pp. 3194–3195.

IBM Technical Disclosure Bulletin, "Conductive Materials in a Resistive Ribbon", vol. 24, No. 4 (Sep. 1981), p. 1918 by Chang et al.

*Primary Examiner*—Ernest T. Wright, Jr.
*Attorney, Agent, or Firm*—John A. Brady

[57] ABSTRACT

A thermal ribbon having a minute coating of graphite powder on the outer side of the resistive layer. The improved electrical interface with print electrodes reduces ribbon and printhead damage. The graphite also reduces friction and loosens material which builds-up at the printhead.

16 Claims, 3 Drawing Figures

MODIFIED RESISTIVE LAYER IN THERMAL TRANSFER MEDIUM HAVING LUBRICATING CONTACT GRAPHITE COATING

DESCRIPTION

Cross-Reference to Related Application

An application, Ser. No. 388,555, filed the same day as this application entitled, as amended, "Laminated Thermal Transfer Medium for Lift-Off Correction and Embodiment with Resistive Layer Composition Including Lubricating Contact Graphite Coating," by Hugh T. Findlay and Keith A. Jones, and assigned to the same assignee to which this application is assigned is directed to the release layer and the materials of the resistive layer in a thermal ribbon. One preferred embodiment of this application includes the release layer and material of the resistive layer which are the same as those described and claimed in that application.

TECHNICAL FIELD

This invention relates to thermal printing, particularly to improving the performance of a resistive layer of a thermal transfer medium in which heating is obtained by electrical current driven by electrodes applied to the resistive layer.

Thermal printing of the kind involved is in the nature of non-impact typewriting. Printing is by flow from melted material from a transfer medium which appears similar to a one-use typewriter ribbon. A lower lamination is resistive and the ribbon is contacted by electrodes, for example with point electrodes and a broad area contact electrode. High current densities in the resistive layer at the point electrodes during an applied voltage pulse produce intense local heating. Ink is transferred from the ribbon to paper at localized areas in which heat is generated. An important factor in the performance of these ribbons is in the response of the resistive layer to current applied, both with respect to current required for adequate heating and with respect to resistance of the resistive layer during the printing operation to degradation from the effects of heating and current flow.

BACKGROUND ART

This invention employs the application of graphite to the outer layer only of such a resistive ribbon. U.S. Pat. No. 4,253,775 to Crooks et al discloses a thermal transfer medium in which the resistive layer is a resin and graphite. The graphite is a particular conductive material dispersed throughout the resin. The graphite is suspended in Kapton (trademark of E. I. DuPont de Nemours & Co.), a polyimide resin, and accordingly functions as the conductive material within the resistive layer to achieve resistivity in a range at which heating can occur.

An article entitled "Conductive Materials in a Resistive Ribbon" in *IBM Technical Disclosure Bulletin,* Vol. 24, No. 4 (September 1981), page 1918 by L. S. Chang et al discloses the manufacture of a resistive ribbon in which the resistive layer is a mixture of carbon and graphite so as to achieve lower viscosity during the processing stages.

Graphite is a well known solid lubricant. Accordingly, it is believed that graphite has been used as an outer lubricant film in various moving systems, including magnetic tape transport systems. In such systems, of course, application of electric current to achieve a degree of heating sufficient for a thermal printing would not be a factor.

DISCLOSURE OF THE INVENTION

In accordance with this invention an outer layer only of graphite is applied to a transfer medium having a resistive layer to receive electrical current for generation of heat by the resistive layer and a layer of marking material meltable by that heat on one side of the resistive layer. Preferably in accordance with this invention the outer layer of graphite is very minute and applied as a substantially pure material. Specific aspects in the best mode include the application of graphite as a pure powder dusted on the ribbon and buffed until the amount of remaining graphite is only that which remains after a thorough buffing with a graphite receptive cloth. This graphite remains as a coating by inherent surface effects between the graphite and the surface of the resistive layer.

The graphite does not greatly reduce printing current, but the graphite does reduce damage from wear and other interface effects between the printing electrodes and the resistive layer. Graphite is believed to form a low resistance electrical, sparking-minimizing connection between the electrodes of the printhead and the body of the resistive layer. The graphite also functions as a solid lubricant to reduce friction. Since build-up of material at the print electrodes in resistive ribbon printing is a significant problem, reduction of friction and sparking at the interface tend to produce conditions where that build-up is minimized. The graphite also functions to loosen any build-up. Without exceptional electrical and physical effects at the interface, the cause for any build-up would be only the result of heating throughout the resistive layer, and if current within the resistive layer does not create exceptional heating throughout that layer, build-up of material and consequent fouling of the printhead can be avoided.

BRIEF DESCRIPTION OF DRAWING

The details of this invention will be described in connection with the accompanying drawing, in which.

BEST MODE FOR CARRYING OUT THE INVENTION

The material of the resistive layer is not a significant factor with respect to this invention, since this invention has been found to enhance the performance of resistive layers in general. Two embodiments will be described with some specifics so as to illustrate the best mode for this invention in two environments. The first environment disclosed is one in which the resistive layer is polycarbonate.

POLYCARBONATE RESISTIVE LAYER

Figure 1:
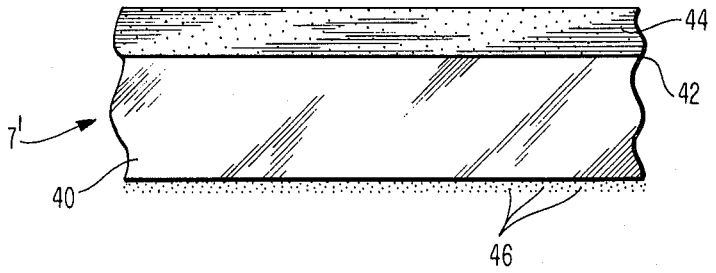
FIG. 1 is a side view of the polycarbonate resistive layer ribbon in accordance with this invention.

This embodiment, illustrated in FIG. 1, is a three-layer laminate ribbon 7' of regular cross-section particularly suited to be used once for printing at one temperature and for lift-off correction using the same ribbon 7' at a lower temperature. The bottom layer 40 is polycarbonate with conductive, particulate carbon black, which acts as a resistive layer 40. The resistive layer 40 typically is 15 microns in thickness. The next layer 42 is a 1000 angstroms thick layer 42 of vacuum deposited aluminum. The third and last layer 44, which is on the aluminum, is a 4 to 6 microns thick ink layer 44 flowable in response to heat created by electric current applied from the outside of the resistive layer 40. The outside of the resistive layer 40 carries graphite 46 (greatly magnified in the drawing and illustrated as dots) which has been dusted on and burnished, resulting in an outer deposit of graphite 46 too small to quantify by conventional measuring techniques. (This polycarbonate embodiment may employ a release layer generally as described for the following embodiment, and the same advantages would be realized.)

The fabrication and specific form of the resistive substrate forms no essential part of this invention. Polycarbonate is used as a resin material in this embodiment. A representative teaching of the fabrication of a polycarbonate substrate for this purpose is disclosed in U.S. Pat. No. 4,103,066 to Brooks et al. Three parts of a polycarbonate resin (which may be Mobay Chemical Corporation Merlon or Makrolon or mixtures thereof with a smaller amount of General Electric Co. GE3320, a polycarbonate block polymer) is dissolved in approximately 93 parts of dichloromethane. Added to this mixture is approximately 1 part of conductive carbon (XC-72 from Cabot Corporation). This is first mixed in a shaker and then dispersed in a ball-mill jar containing steel balls. The dispersion is reverse roll coated on a 5 mil Mylar substrate to the desired dry thickness. (Mylar is a trademark of Du Pont for polyethylene terephthalate.) Solvent is then evaporated away.

POLYURETHANE-ETHYL ACRYLATE SUBSTRATE

Figure 2:
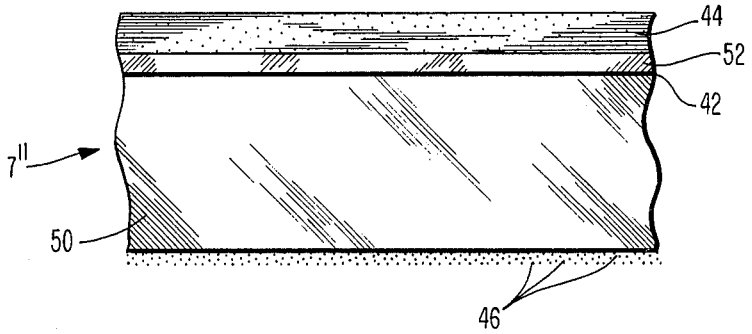
FIG. 2 is a side view of the polyurethane-ethyl acrylate resistive layer ribbon in accordance with this invention.
Figure 3:
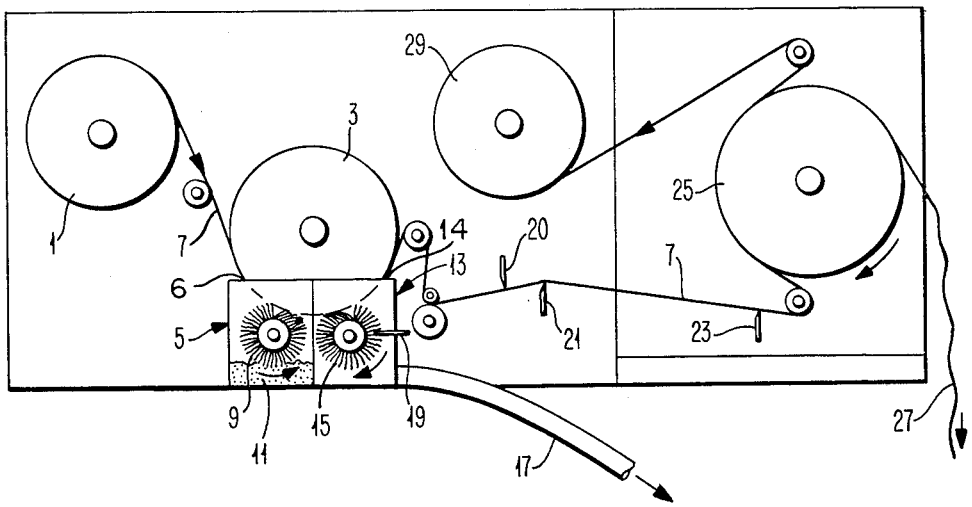
FIG. 3 illustrates the manner of graphite coating.

FIG. 2 illustrates this embodiment, with reference numerals to essentially identical elements the same as those used with the foregoing embodiment. As the basic fabrication techniques and the material of the marking layer 44 are identical in these two embodiments, the differing parts of the second embodiment will be described here, followed by the description common to the two embodiments. This polyurethane-ethyl acrylate ribbon 7'' is a four-layer lamination of regular cross-section particularly suited to be used once for printing at one temperature and for lift-off correction using the same ribbon 7'' at a lower temperature. The bottom layer 50 is a blend of aliphatic polyurethane and a urethane acrylic copolymer with conductive, particulate carbon black, which acts as a resistive layer 50. The resistive layer 50 is 17 microns in thickness. The next layer 42 is a 1000 angstroms thick layer 42 of vacuum-deposited aluminum. The next layer 52 is a release layer 52, which is 2 microns in thickness. Finally, on the release layer 52 is a 4 microns thick ink layer 44 flowable in response to heat created by electric current applied from the outside of the resistive layer 50. The outside of the resistive layer 50 carries graphite 46 which has been dusted on and burnished, resulting in an outer deposited graphite 46 too small to quantify by conventional measuring techniques. The dry ingredients of the resistive layer 50 by weight are as follows:

RESISTIVE LAYER - DRY INGREDIENTS

| Material | % By Weight |
|---|---|
| (1) Aliphatic polyurethane | 37.5 |

-continued

RESISTIVE LAYER - DRY INGREDIENTS

| Material | % By Weight |
|---|---|
| (2) Urethane-Ethyl Acrylate Copolymer | 37.5 |
| (3) Conductive Carbon Black | 25.0 |

The aliphatic polyurethane is a dry ingredient of Neorex R960, a trademark of Polyvinyl Chemical Industries. The urethane appears to have few polar or reactive functional groups other than the urethane linkages. Nevertheless, the material is described by its manufacture as suited to be cross-linked at carboxyl functional groups in the urethane.

The copolymer is the dry ingredient of UXP102, trademark of Polyvinyl Chemical Industries. That is a copolymer of 50% by an molecule weight urethane and 50% by molecule weight ethyl acrylate.

The preferred resistive layer 50 is cast from a predominately water borne dispersion. The following formula for the dispersion is prepared by mixing and grinding the following ingredients together in a standard high-shear mixer until particle wetting is complete, typically one hour for small batches.

Resistive Layer - Dispersion Formula

| Ingredient | % By Weight |
|---|---|
| (1) Neorez R-960* (Polyvinyl Chemical Industries aliphatic urethane dispersion) | 34.6 |
| (2) XC72R (Cabot Co. conductive carbon black) (100% solid particles with exceptionally high surface area) | 7.8 |
| (3) UXP102** (Polyvinyl Chemical Industries copolymer of urethane and ethyl acrylate | 34.6 |
| (4) Water (additional to water above) | 23.0 |

*Neorez R-960 consists of the following by weight: 33% aliphatic urethane, 15% N—methyl-2-pyrrolidone, 1.2% ethylamine, and 50.8% water.

**UXP102 consists of the following by weight: 33% copolymer of 50% by molecule weight urethane and 50% by molecule weight ethyl acrylate: 1.2% ethylamine: and 65.8% water.

The resistive layer 50 dispersion is cast by a reverse roll coater onto a temporary release substrate. This may be a 4 millimeter thick polypropylene or polyethylene terephatalate (Imperial Chemical Industries) film. Drying is then conducted by forced hot air. The upper surface is then metalized by vacuum deposition of aluminum to a thickness of 1000 angstroms. The intermediate, release layer 52 is then deposited on the aluminum layer 42. This is also applied as a water-borne dispersion from a reverse roll coater.

The preferred release layer 52 is ethylene organic acid copolymer of 95% by weight ethylene and 5% by weight organic acid. This material is cast from an emulsion.

The material used is commercially obtained as Esi-Cryl 2540-N, a product of Emulsion System Inc. This is a 25% solids emulsion of water and a non-ionic surfactant. The organic acid part of the polymer appears to be acrylic acid. The copolymer is of molecular weight of 3000 to 3500, and has a softening point of 108° C.

The Esi-Cryl 2540-N is coated without modification on the aluminum layer 42 using a reverse roll coater. Drying is then conducted by forced hot air.

Also, very satisfactory results have been achieved by using a linear crystal polyethylene as the material of intermediate layer 52. Material used is commercially obtained as Poly Emulsion 316 N30, a product of Chemical Corporation of America. This is an aqueous emulsion of the polyethylene, which is characterized by high degree of slip and hardness, and by high melt viscosity.

It is coated and used as a release layer 52 as described for the preferred ethylene organic acid copolymer.

The remaining elements of the two embodiments, the polycarbonate substrate embodiment and the polyurethane-ethyl acrylate substrate embodiment, are substantially identical and will be discussed together in the following. In both embodiments printing is effected by known techniques in which the resistive layer 40, 50 is contacted with point electrodes (9 in U.S. Pat. No. 4,384,797, discussed in some detail in the next paragraph). The aluminum layer 42 (or, alternatively the resistive layer 40, 50) is contacted with a broad area electrode (32 or 30 in U.S. Pat. No. 4,384,797). The point electrodes (9 in U.S. Pat. No. 4,384,797) are selectively driven in the form of images desired with sufficient current to produce local heating which causes transfer of ink from the ribbon 7 to a paper or other substrate (5 in U.S. Pat. No. 4,384,797) in contact with ribbon 7.

Lift-off correction is as described in U.S. Pat. No. 4,384,797 to Anderson et al, filed Aug. 13, 1981, entitled "Single Laminated Element for Thermal Printing and Lift-Off Correction, Control Therefor and Process," and assigned to the same assignee to which this application is assigned. The erase operation is effected over an incorrect character in the manner of printing. The ribbon 7 is not stripped away until after a cooling period. The correction operation may be in a manner otherwise identical with ordinary printing of the incorrect character, or it may be with the activation of all printing electrodes (9 in U.S. Pat. No. 4,384,797) (block erase) where the return to the correct character may be slightly out of registration. During correction the printing speed may be reduced, but this is a non-essential design alternative.

The ink layer 44 formula and final ink layer 44 in the embodiments described here are essentially identical to the ink layer for self correction of the foregoing U.S. Pat. No. 4,384,797. Accordingly the formulation is as follows:

Ink Layer Formula

| Component | Parts by Weight | % Solids |
|---|---|---|
| Adcote 37JD610 (An ethylene vinyl acetate copolymer of 6300 weight average molecular weight; approximately 90% by weight being the polyethylene component; with about 6% by weight rosin acids as dispersants; 40% total solids in water; trademark product of Morton Chemical Co.) | 6 | 73.4 |
| Hycar 2600X120 (Polyethylacrylate, with about 4% by weight polyacrylonitrile, some dispersant; 50% solids in water; trademark product of B. F. Goodrich Chemical Co.) | 1 | 15.3 |
| Aquablack 140 (Carbon black, 7% by weight naphthalene sulfonic acid dispersant; 37% solids in water; trademark product of Bordon Chemical, Division of Bordon Inc.) | 1 | 11.3 |
| Water (distilled, additional to water in foregoing) | 1 | — |

In the polycarbonate embodiment the layer 42 coated with the marking layer 44 is the aluminum layer 42. In the urethane and ethyl acrylate embodiment the layer 52 coated with the marking layer 44 is the intermediate layer 52. In both embodiments the layer 45, 52 is overcoated using a reverse roll coater for the ink layer 44 formula dispersion to a thickness to produce the desired dry thickness. Drying by evaporation of the water vehicle is then conducted using forced hot air. The combined resistive layer 40, 50 with intermediate layer 42 or layers 42, 52 and top ink layer 44 is then stripped from the temporary substrate. This is a bulk ribbon 7 to which a minute graphite coating 46 is then applied to the outer surface of the resistive layer 40, 50. After the graphite application, the bulk ribbon 7 is slit to the desired width and wound into a spool.

GRAPHITE APPLICATION

The graphite 11 is an outer layer on the resistive layer 40, 50 and may be applied prior to the application of other parts of the ribbon 7. Typically, it will be applied last, and this discussion assumes the ribbon 7 is otherwise finished when the graphite 11 is applied. The graphite 11 applied is a powder.

The graphite 11 used is the Micro-850 product of Asbury Graphite Mills, Asbury, N.J. This is understood to be the cleanest and smallest in particle size graphite sold commercially by that company, which company is understood to offer a representative range of graphite products. The particle size is understood to be 0.5 to 0.6 micron in average diameter. The graphite 11 is natural as opposed to synthetic and is understood to have an ash content of 1% by weight maximum. (The ash would be primarily silicon oxides and metal oxides and the like, and is essentially the residual extraneous materials from processing.)

The drawing illustrates significant elements of the preferred station to apply the dusted-on graphite 11. Mechanical details to turn the mechanisms and direct the bulk ribbon 7 are not specifically indicated as they are not exceptional and may be conventional. The supply roll 1 in a commercial process is an otherwise finished bulk roll as just described. This is fed to a back-up roll 3 with the resistive layer 40, 50 outward.

Back-up roll 3 is situated in applicator tank 5, which is closed except for felt sealed, small openings 6 to receive ribbon 7 and roll 3. Applicator roll 9 is a paint roll of soft, artificial cloth. Roll 9 rotates continuously during graphite application and physically rubs against ribbon 7. It dips into the graphite powder 11 on the floor of tank 5 and carries graphite 11 in its fibers in the manner of painting. Graphite 11 transfers to ribbon 7 as roll 9 rubs against it. The direction of movement of roll 9 is not important.

Ribbon 7 exits tank 5 having the transferred graphite 11 on its surface. It immediately enters cleaning tank 13. Tank 13 also is closed except for small felt sealed openings 14 to receive ribbon 7 on roll 3. Cleaning brush 15 in tank 13 rotates in the direction of travel of ribbon 7. The direction of rotation, however, is not important. Brush 15 is also a paint roll of soft cloth which tends to capture excess graphite 11. Vacuum line 17 pulls graphite 11 from the air in tank 13. After an area of brush 15 leaves the ribbon 7 it encounters beater bar 19, a stationary bar which is positioned to disturb the cloth of brush 15. This shakes loose graphite 11 from brush 15, which is then removed by vacuum line 17.

Ribbon 7 then leaves tank 13 and is guided past one upper, sharp scraper blade 20 and two longitudinally spaced, sharp scraper blades 21 and 23. Blades 20, 21 and 23 may be or have the characteristics of razor blades. Where the operation of cleaning brush 15 or other cleaners is sufficient, scraper blades 20, 21 and 23 may be wholly eliminated. The top blade 20 is for scraping off graphite 11 which settles from the atmosphere from tank 5 around the edges of ribbon 7. Where the bulk ribbon 7 is wide, these edges may be trimmed off. In any event, tension on scraper blades 20, 21 and 23 is very light.

Ribbon 7 is guided around a roll 25 of tissue 27. Tissue 27 may be or have the characteristics of toilet tissue. The resistive layer 40, 50 side of ribbon 7 covers most of one side of the curved surface of roll 25. Roll 25 moves in the direction of ribbon 7 and at slightly greater velocity (the direction movement is not critical). Tissue 27 is fed away from roll 25 so that the outer surface of roll 25 is continuously renewed. Where the operation of cleaning brush 15 or other cleaners is sufficient, tissue 27 may be wholly eliminated.

The foregoing manufacture results in a final dusting and polishing of graphite 11 which leaves a coating 46 so minute as not to be measurable by ordinary techniques. The graphite coating 46 remains by inherent surface effects between the graphite coating 46 and the surface of the resistive layer 40, 50. The silver appearance of graphite 11 does appear on the surface.

The complete ribbon 7 is rolled into a take-up spool 29. That is a bulk roll ready to be slit to the desired width and wound into a spool.

It will be apparent that various modifications can be made in the foregoing without departing from the basic inventive concepts described. Accordingly, patent coverage claimed is as follows.

What is claimed is:

1. A transfer medium having a resistive layer to receive electrical current for generation of heat, a layer of marking material meltable by said heat on one side of said resistive layer, and graphite powder in minute, normally unmeasurable amounts coating the surface of said resistive layer opposite said one side and adhering substantially only by inherent surface effects between said graphite and the surface of said resistive layer, said graphite coating giving a silver appearance and providing lubrication and enhanced electrical current-flow parameters.

2. The transfer medium as in claim 1 in which said graphite is that graphite which remains after applying graphite to said surface opposite said one side and thoroughly rubbing said applied graphite with a soft cloth to capture graphite.

3. The transfer medium as in claim 1 in which said resistive layer consists essentially of a polycarbonate resin binder and carbon black.

4. The transfer medium as in claim 2 in which said resistive layer consists essentially of a polycarbonate resin binder and carbon black.

5. The transfer medium as in claim 1 in which said resistive layer consists essentially of a polyurethane resin binder and carbon black.

6. The transfer medium as in claim 2 in which said resistive layer consists essentially of a polyurethane resin binder and carbon black.

7. A transfer medium having a resistive layer consisting essentially of a polymeric resin binder and a conductive, particulate filler; a layer of marking material on one side of said resistive layer meltable by heat generated by electrical current introduced into said resistive layer; and graphite powder in minute, normally unmeasurable amounts coating said resistive layer on the side opposite said one side, and graphite powder adhering substantially only by inherent surface effects between said graphite powder and the surface of said resistive layer, said graphite coating giving a silver appearance and providing lubrication and enhanced electrical current-flow parameters.

8. The transfer medium as in claim 7 in which said graphite powder is that graphite powder which remains after applying graphite powder to said surface opposite said one side and thoroughly rubbing said applied graphite powder with a soft cloth to capture graphite powder.

9. The transfer medium as in claim 7 in which said resin is polycarbonate and said filler is carbon black.

10. The transfer medium as in claim 8 in which said resin is polycarbonate and said filler is carbon black.

11. The transfer medium as in claim 7 in which said resin is polyurethane and said filler is carbon black.

12. The transfer medium as in claim 8 in which said resin is polyurethane and said filler is carbon black.

13. The transfer medium as in claim 9 also comprising an aluminum layer of thickness in the order of magnitude of 1000 angstroms contacting said resistive layer between said resistive layer and said layer of marking material.

14. The transfer medium as in claim 10 also comprising an aluminum layer of thickness in the order of magnitude of 1000 angstroms contacting said resistive layer between said resistive layer and said layer of marking material.

15. The transfer medium as in claim 11 also comprising an aluminum layer of thickness in the order of magnitude of 1000 angstroms contacting said resistive layer between said resistive layer and said layer of marking material.

16. The transfer medium as in claim 12 also comprising an aluminum layer of thickness in the order of magnitude of 1000 angstroms contacting said resistive layer between said resistive layer and said layer of marking material.

* * * * *